US010617171B2

(12) United States Patent
Mayrhofer et al.

(10) Patent No.: US 10,617,171 B2
(45) Date of Patent: Apr. 14, 2020

(54) SPORTS BOOT FOR THE PURSUIT OF SKI SPORT

(71) Applicant: ATOMIC Austria GmbH, Altenmarkt im Pongau (AT)

(72) Inventors: Simon Mayrhofer, Altenmarkt im Pongau (AT); Jason Roe, Altenmarkt im Pongau (AT); Gerhard Trinkaus, Altenmarkt im Pongau (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 29 days.

(21) Appl. No.: 16/009,390

(22) Filed: Jun. 15, 2018

(65) Prior Publication Data

US 2019/0014857 A1 Jan. 17, 2019

(30) Foreign Application Priority Data

Jul. 13, 2017 (AT) ..... 50588/2017

(51) Int. Cl.
*A43B 5/04* (2006.01)
*A43B 3/00* (2006.01)
(Continued)

(52) U.S. Cl.
CPC ..... *A43B 5/04* (2013.01); *A43B 3/0005* (2013.01); *A43B 13/14* (2013.01); *A43B 21/00* (2013.01);
(Continued)

(58) Field of Classification Search
CPC ..... A43B 3/0005; A43B 5/04; A43B 5/0415
(Continued)

(56) References Cited

U.S. PATENT DOCUMENTS 4,814,661 A * 3/1989 Ratzlaff ..... A01L 11/00 310/319
5,408,873 A * 4/1995 Schmidt ..... A43B 3/0005 600/592
(Continued)

FOREIGN PATENT DOCUMENTS

AT 517 933 B1 6/2017
DE 9 417 953 U1 1/1995
(Continued)

*Primary Examiner* — Marie D Bays
(74) *Attorney, Agent, or Firm* — Collard & Roe, P.C.

(57) ABSTRACT

The invention relates to a sports boot for the pursuit of ski sport. The sports boot comprises a sensor arrangement (29) having several pressure-sensitive sensors (9*a-d*) in a distributed layout which are respectively connected or can be connected via cable connections (17*a-d*) to an electronic signal processing device. At least one first sensor (9*a*) is positioned in a forefoot portion (31) of the sole arrangement (30) of the sports boot and at least one second sensor (9*b*) is positioned in a heel portion (32) of the sole arrangement (30). A first cable connection (17*a*) between the at least one first sensor (9*a*) and the electronic signal processing device and a second cable connection (17*b*) between the at least one second sensor (9*b*) and the electronic signal processing device are respectively starting from the at least one first sensor (9*a*) and from the at least one second sensor (9*b*) and each run in the direction towards a sole center region (34) of the sole arrangement (30). The first and second cable connection (17*a*, 17*b*) then run out from the sole center region (34) via the heel portion (35) in the direction towards the upper boot portion (28) in which the signal processing device is positioned or can be positioned.

12 Claims, 5 Drawing Sheets

Figure 1:
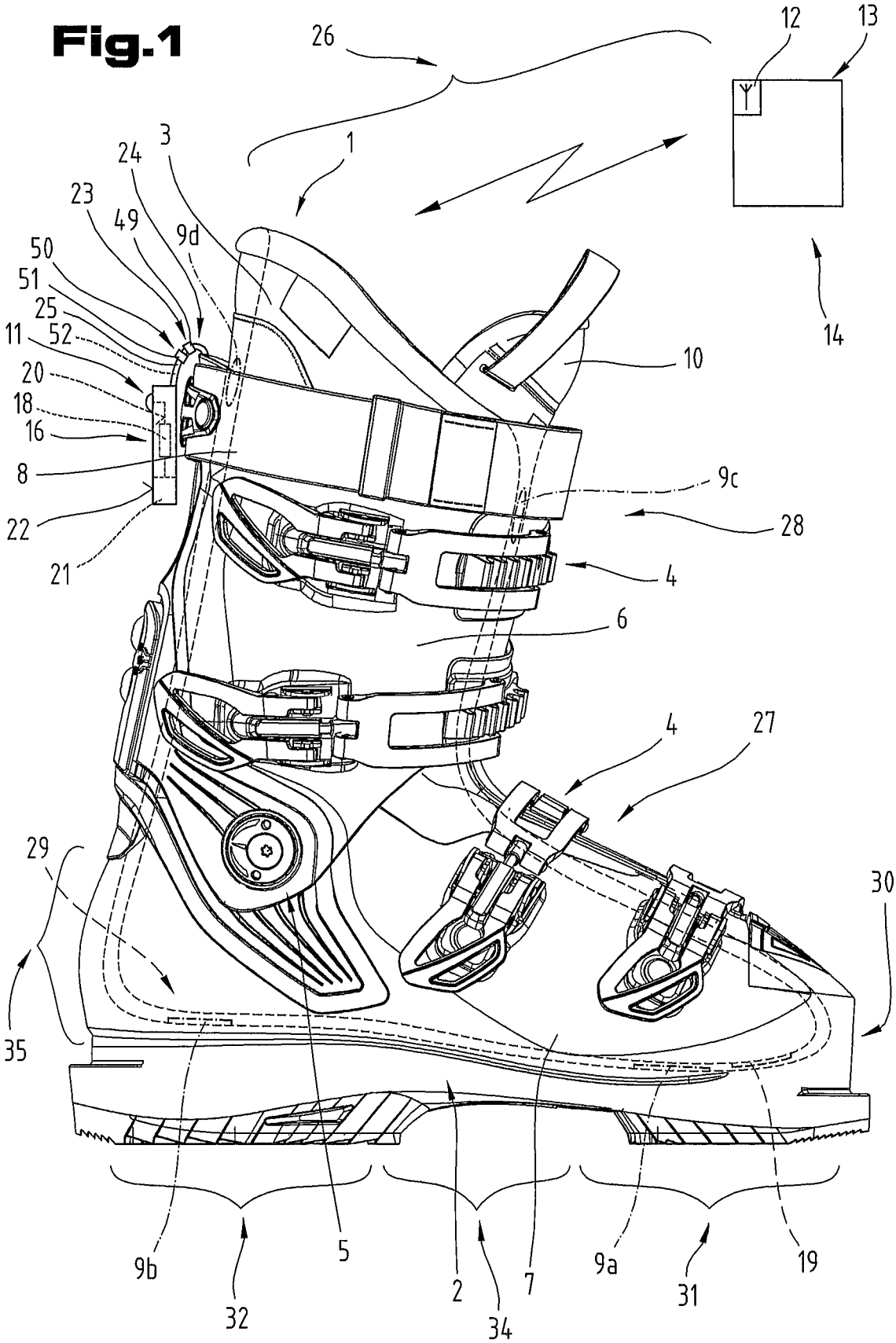

(51) Int. Cl.

| | |
|---|---|
| ***A43B 13/14*** | (2006.01) |
| ***A43B 23/26*** | (2006.01) |
| ***A43B 21/00*** | (2006.01) |
| ***A63B 24/00*** | (2006.01) |
| ***A63B 69/18*** | (2006.01) |
| ***A43B 23/02*** | (2006.01) |
| *A43B 1/14* | (2006.01) |

(52) U.S. Cl.
CPC ..... *A43B 23/0245* (2013.01); *A43B 23/26* (2013.01); *A63B 24/0062* (2013.01); *A63B 69/18* (2013.01); *A43B 1/14* (2013.01); *A63B 2220/56* (2013.01); *A63B 2220/836* (2013.01); *A63B 2244/19* (2013.01)

(58) Field of Classification Search
USPC ..... 36/117.1, 136
See application file for complete search history.

(56) References Cited

U.S. PATENT DOCUMENTS 6,360,597 B1 3/2002 Hubbard, Jr.
7,426,873 B1 * 9/2008 Kholwadwala ..... A43B 3/00 73/777
7,997,007 B2 * 8/2011 Sanabria-Hernandez ..... A43B 3/0005 36/1
8,740,751 B2 6/2014 Shum
2003/0097878 A1 * 5/2003 Farringdon ..... A61B 5/1038 73/819
2008/0066343 A1 * 3/2008 Sanabria-Hernandez ..... A43B 3/0005 36/43
2009/0234249 A1 * 9/2009 Randolph ..... A43B 3/0005 600/592
2009/0235739 A1 9/2009 Morris Bamberg et al.
2010/0000121 A1 * 1/2010 Brodie ..... A43B 3/0005 36/28
2011/0131012 A1 * 6/2011 Czaja ..... A43B 3/0005 702/188
2011/0214501 A1 * 9/2011 Ross ..... A43B 3/0005 73/172
2011/0251520 A1 * 10/2011 Shieh ..... A43B 3/0005 600/587
2012/0291564 A1 * 11/2012 Amos ..... G01C 22/006 73/862.045
2013/0174451 A1 * 7/2013 Kremer ..... A43B 3/0005 36/136
2014/0326085 A1 * 11/2014 Lee ..... A61B 5/6829 73/865.4
2016/0038788 A1 * 2/2016 McMillan ..... G01L 5/18 73/488
2016/0219968 A1 * 8/2016 Martin ..... A43B 3/0005
2016/0252412 A1 * 9/2016 McMillen ..... A43B 3/0005 73/774
2016/0287937 A1 * 10/2016 Fitzgerald ..... G06K 9/00342
2016/0313174 A1 * 10/2016 Lightstone ..... G01G 19/50
2016/0375346 A1 * 12/2016 Czaja ..... A63C 11/003 434/253
2017/0225033 A1 * 8/2017 Czaja ..... A43B 5/0405
2017/0336870 A1 * 11/2017 Everett ..... G06F 3/0383
2018/0146737 A1 * 5/2018 Goodrich ..... A43B 3/0005
2018/0169474 A1 * 6/2018 Reddy ..... A63B 24/0062
2018/0236352 A1 * 8/2018 El-Sheimy ..... A63F 13/428
2018/0333078 A1 * 11/2018 Malawey ..... A61B 5/1038
2019/0000177 A1 * 1/2019 Dervish ..... A43B 3/0005

FOREIGN PATENT DOCUMENTS

GB 2 441 733 A 3/2008
WO 01/39655 A2 6/2001
WO 2007/015908 A2 2/2007

* cited by examiner

SPORTS BOOT FOR THE PURSUIT OF SKI SPORT

CROSS REFERENCE TO RELATED APPLICATIONS

Applicant claims priority under 35 U.S.C. § 119 of Austrian Application No. A 50588/2017 filed on Jul. 13, 2017, the disclosure of which is incorporated by reference.

The invention relates to a sports boot for the pursuit of ski sport, as specified in the claims.

WO2007/015908A2 describes a system for displaying the athletic performance of a runner on electronic devices. To this end, the signals of a step sensor in the sole of the running shoe, a heart rate and/or blood pressure sensor on the body of the runner and other sensor data are wirelessly transmitted to an electronic adapter device. The adapter device, which receives at least the step signals, can be mechanically connected to and disconnected from the data interface of a standard display device by means of a plug and transmits the data to be displayed by means of the display device via this data interface. The adapter device and the display device, which may be provided in the form of a standard mobile telephone, a PDA, an MP3 player, a wristwatch and such like, are worn on the user's body and are provided as a means of evaluating the user's running performance. This known system is only suitable for use with ski sports under certain circumstances.

DE9417953U1 describes an insert for a ski boot. This insert is intended for use as a learning aid to correct carving. It consists of a flat and flexible insert part covering the heel region. Disposed in this insert part is a cell filled with a liquid and a sensor which reacts to pressure is disposed in the cell and connected via cables to a power supply and a controller outside the ski boot. The controller is in turn connected to a device for generating acoustic signals, in particular a stereo headset. As an aid to carrying out ski sports, this device is only satisfactory under certain circumstances.

The objective of the invention was to overcome the disadvantages of the prior art and provide skiers with technical equipment enabling them to increase comfort and/or achievable performance when pursuing sports activities.

This objective is achieved by a sports boot as described herein.

The advantage obtained by the features described herein is that a ski and/or sports boot of the generic type can assist the respective user in terms of increasing comfort and hence also pleasure when pursuing ski sport. Alternatively to or in combination with increasing comfort, however, an increase in performance can also be achieved because the corresponding sports boot constitutes an instrument and/or aid by means of which a so-called digital training system or "digital coach" can be set up. Especially in conjunction with appropriate electronic and/or data processing equipment, the corresponding sports boot represents an ideal element for analyzing the motion behavior of the skier.

Another advantage of the design proposed by the invention resides in the fact that at least the balance performance of the sportsperson, in particular so-called sense of balance, can be determined and information thus gleaned as to whether the skier has adopted too pronounced a forward stance or backward lean. This is achieved with the specified sensor arrangement in an efficient and at the same time informative manner in particular. The respective balance is of great importance primarily in connection with ski boots used for alpine ski sports.

Another particular advantage of the design proposed by the invention resides in the fact that the corresponding sports boot can be made relatively economically and also has optimized comfort or wearing behavior. In particular, the risk or likelihood of undesired pressure points on the typically relatively pressure-sensitive foot of a sportsperson is minimized or kept to a minimum. Especially due to the fact that the cable connections of the sensors in the sole arrangement run respectively in the direction towards the sole center where the arch of the user's foot is disposed during use of the sports boot, pressure points can be avoided if the respective cable runs have corresponding cross-sections and/or height dimensions. In particular, this also simplifies the electrical wiring and electrical connection, keeping costs as low as possible. For example, by using standard inexpensive copper conductors or cable wires for the cable connections, undesired pressure points on the user's foot can be prevented.

Furthermore, due to the feature whereby the cable connections to and/or from the pressure-sensitive sensors in the sole arrangement are run via the heel portion jointly in the direction towards the upper boot portion, a layout is achieved that is as uncomplicated as possible and hence inexpensive to produce. In particular, the cable run via the heel portion of the sports boot and/or inner boot results in a robust layout that is also uncomplicated and economic to produce.

Furthermore, by providing or positioning the signal processing device in the upper boot portion, the most optimized mounting position can be selected in terms of wearer comfort, robustness and the service life of electrochemical power sources.

Another advantage of the features proposed by the invention resides in the fact that the sports boot is based on a boot or so-called "high shoe" design which extends above the ankle portion of a user. This primarily enables the most optimum detection of the respective balance performance and/or forward stance and backward lean of the user in terms of reliability and information.

Also of advantage are features related to a ground wire and a ground junction because, so to speak, a central ground junction is obtained which simplifies wiring. Furthermore, placing this ground junction in the sole center region of the sole arrangement results in a problem-free disposition and/or optimized positioning in terms of space requirement. By minimizing the wire lengths for the ground wires, a low overall weight can also be achieved and assembly costs can-be kept as low as possible.

The features related to a further sensor in a calf region of the boot offer an advantage in that a most informative evaluation of the sportsperson can be achieved in terms of his/her weight shift. In particular, forward stance and/or backward leaning positions and the respective balance values of the user can be determined on a reliable and particularly meaningful basis if the values of this shin-pressure sensor are combined with the pressure values of the sensor arrangements on the sole arrangement. Running the cable connection via the region of the instep portion and toe portion, the sole arrangement and heel portion of the sports boot also offers the advantage of a cable connection that will be as robust as possible and functional in the long term. Especially in the case of sports boots of the generic type having a relatively lengthy tongue portion which is intended to make it as easy as possible to step into the sports boot, the specified design makes for improved implementation. Furthermore, there is no need for extra cable lengths, elastic transition pieces or loops from the tongue of the sports boot in the direction towards the adjoining portions of the sports boot.

Also of advantage are the features related to a ground junction for a further cable connection, because the length of the cable and/or ground wires needed in total can be kept low.

Also of advantage are the features related to cable connections running in recesses or indentations in a sole layer, because a system of housing channels for the cable connections is obtained which guarantees a structured or ordered run for the cable connections. This also avoids or prevents any pressure points on the user's foot, and also cable connections having larger cross-sections can be run through the structure or material of the sole arrangement without difficulty. Using the bottom face of the sole arrangement for this offers the advantage of ease of assembly and good accessibility, thereby enabling production costs to be kept as low as possible.

Also of advantage are the features related to a ground junction being disposed in a free space in a bottom face of a sole layer, because they provide good accessibility for fitting and wiring work and also ensure that undesired pressure points relative to the user's foot are avoided.

Also of advantage are the features related to the sensors being film resistance sensors and glued or stitched onto a bottom face of a sole layer, because sensors with a relatively limited detection area in terms of surface area are provided, in particular with a local characteristic as opposed to the entire surface of the sole arrangement, thereby enabling an evaluation of the respective pressure and/or load conditions that is as precise and simple as possible. The specified features also mean that a simple implementation can be achieved and production of the sports boot is as inexpensive as possible.

Increased robustness of the sports boot is achieved as a result of the features related to a protective layer over recesses and/or a free space of a sole layer. Everyday suitability or practicality can be assured in particular if the electric cable connections are disposed in the sole arrangement of an inner boot, which inner boot is designed to be removed from the outer, relatively hard shell of plastic for reasons of comfort. Furthermore, the slim thickness of the protective layer ensures that the pressure-sensing conditions and/or detection conditions are not impaired. To this end, in addition to having a slim thickness, the protective layer has a sufficiently high flexibility, such as can be achieved in a known manner using leather or textile materials or plastic films.

Also of advantage are the features related to a further sensor in a calf region of the boot, because the weight distribution of the sportsperson can be reliably and precisely detected in optimized form whilst engaged in the ski sport. In particular, excessive forward or backward lean of the user can be reliably detected, as a result of which a sensor-generated and/or electronic evaluation result that is as informative as possible can be obtained and thus logged and/or communicated. In particular, an optimized evaluation of the system and/or user states can be guaranteed as a result using sports boots based on a boot design, as is typically the case with ski boots.

The features related to plug interfaces connected to the cable connections are also of particular advantage because the signal processing device does not have to be a fixed and/or permanent element of the sports boot. In particular, therefore, the electronic signal processing device can also be detached from the sports boot for maintenance work and charging without the need for any particular skill or technical know-how. Another advantage of this is that the sports boot can in principle be sold or offered for sale with the sensors fixedly mounted therein and an end user left free to decide whether to fit the electronic signal processing device and the electronic control system. Furthermore, it is therefore also easily possible to then opt for an upgrade with respect to the electronic control function subsequently if the owner of the sports boot so wishes.

The features related to a cable connection running directly to a first plug interface are of advantage because the cable connections are relatively short and the complexity of the structure can be kept to an absolute minimum.

Running the cable connections in the rearward region of the sports boot, i.e. in an Achilles region of the boot, offers the advantage that the sensitivity of the user's foot to pressure is relatively low there and there are no or barely any bothersome pressure points. This also makes for relatively practical production, which simplifies the assembly process. In particular, a cable run in the side portion of the sports boot, either on the internal or external face thereof, would be relatively more complex and would require more complex production technology. In addition, mounting the plug interface and signal processing device in the upper, rear portion of the sports boot is practical in terms of ergonomics, comfort and performance. In particular, space requirements can be satisfied relatively easily, thereby also enabling the signal processing device to be accommodated inside or underneath a trouser leg of the user.

Finally, the features related to the boot being a ski boot with an outer and inner shell are also of advantage because they provide an electrical or digital training and/or control which is capable of analyzing performance of the ski sport and providing the user with informative feedback relating to the respective performance. Mounting the pressure-sensitive sensors in or on the inner boot offers advantages in terms of production, comfort and technical function.

Also of advantage is another embodiment because high practical use of the sports boot can be achieved and reliable functioning of the inner boot can be guaranteed, even in the event of intensive use.

To provide a clearer understanding, the invention will be explained in more detail with reference to the appended drawings.

Figure 2:
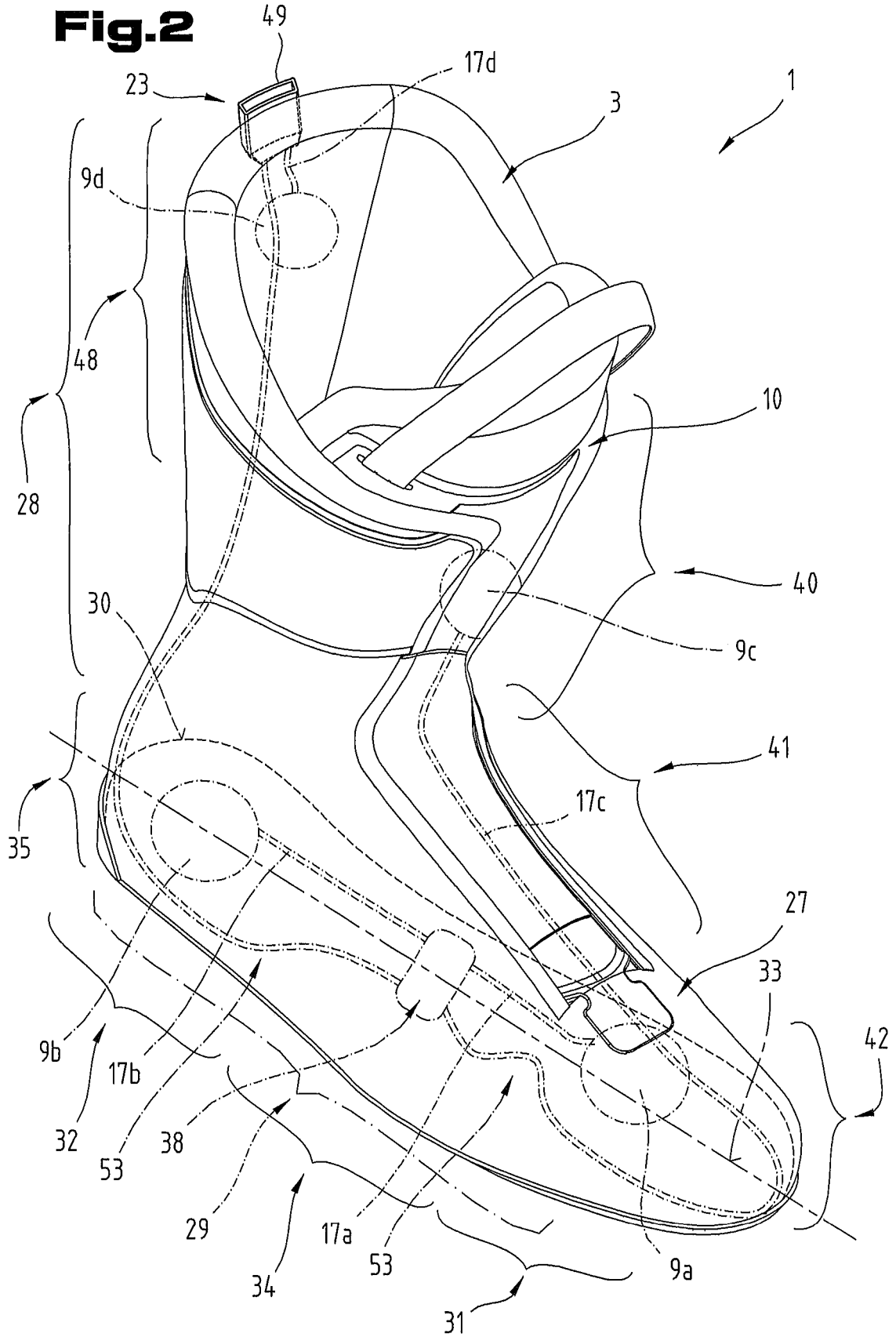
Figure 3:
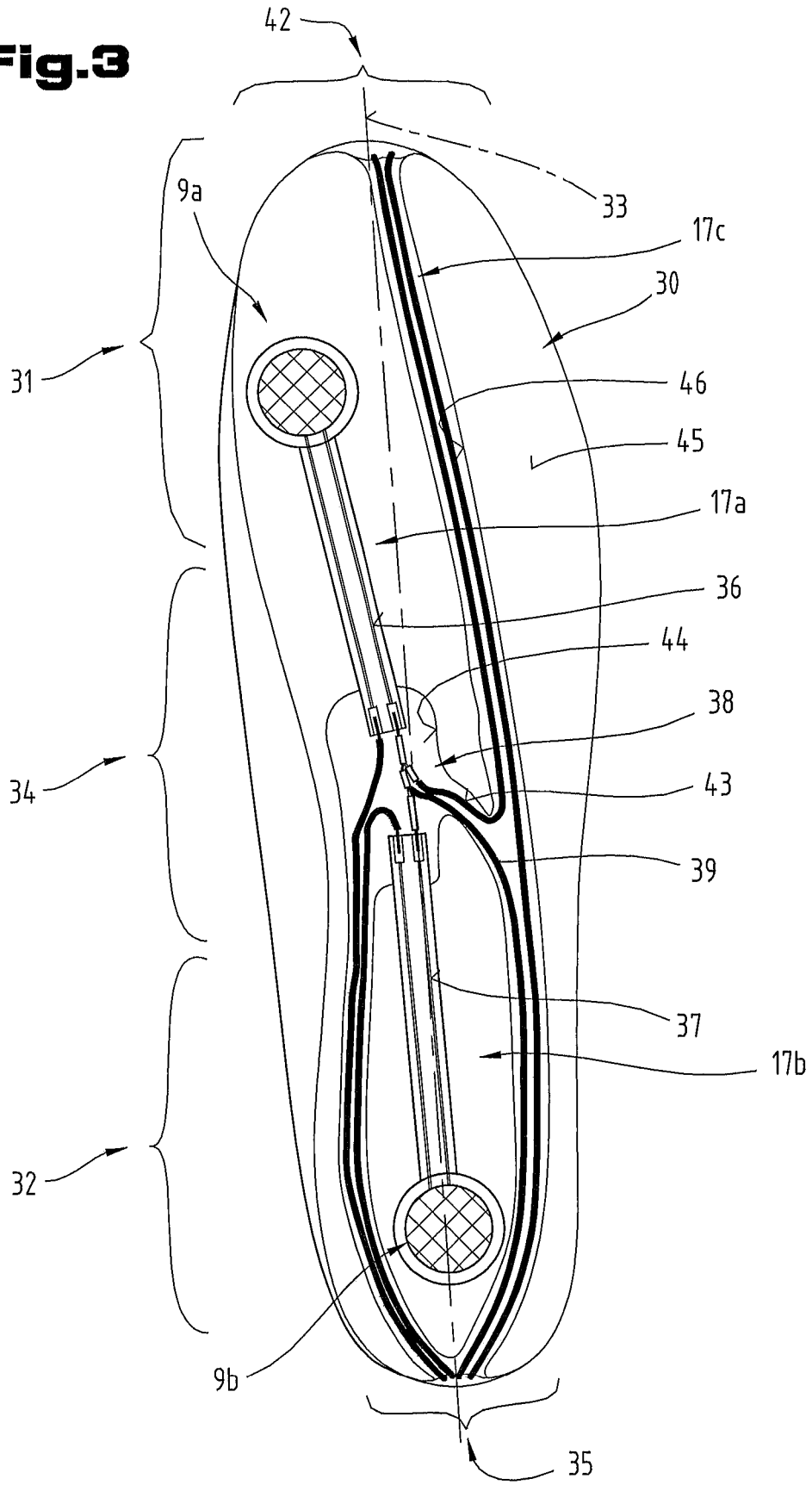
Figure 4:
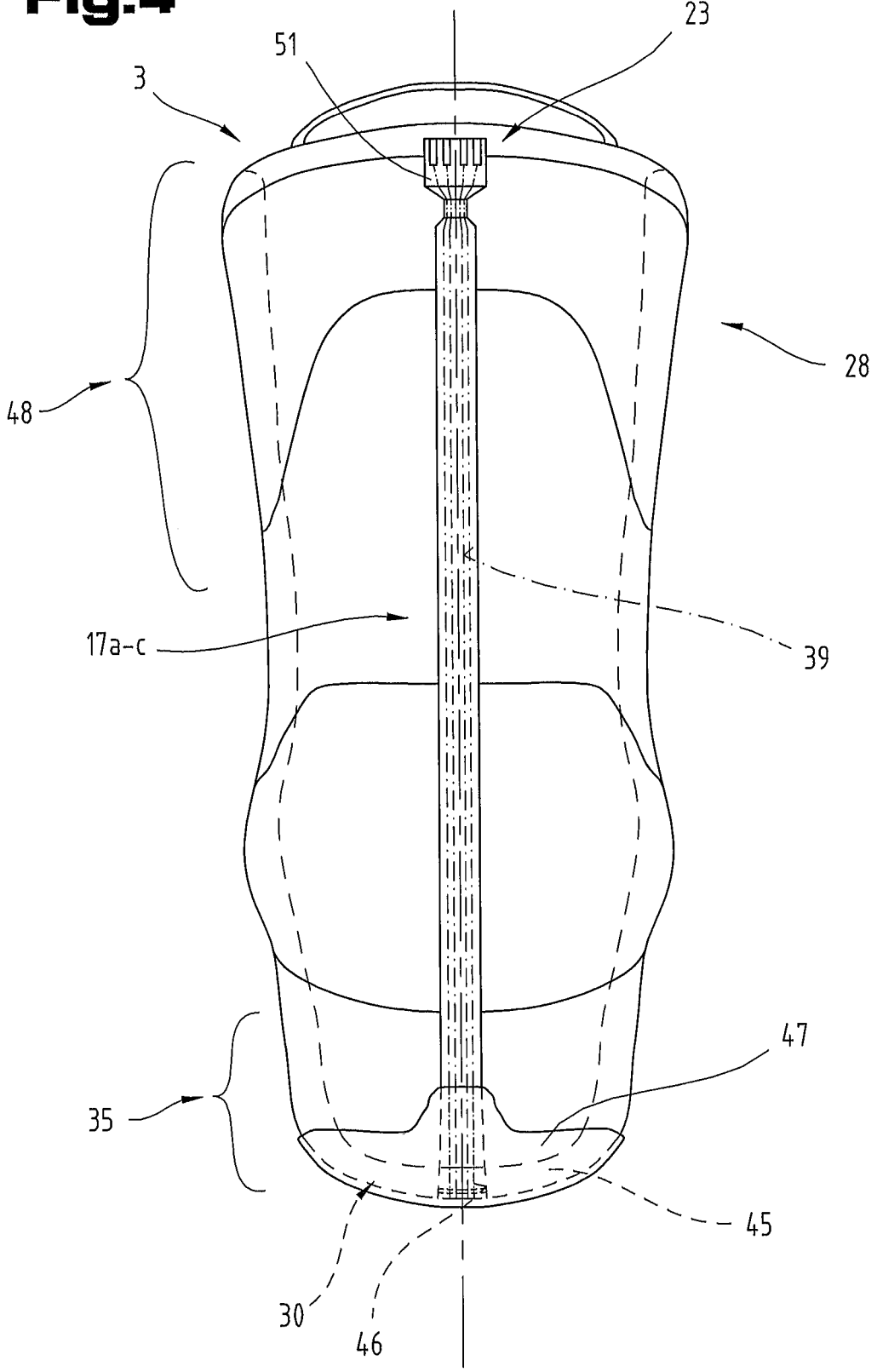
Figure 5:
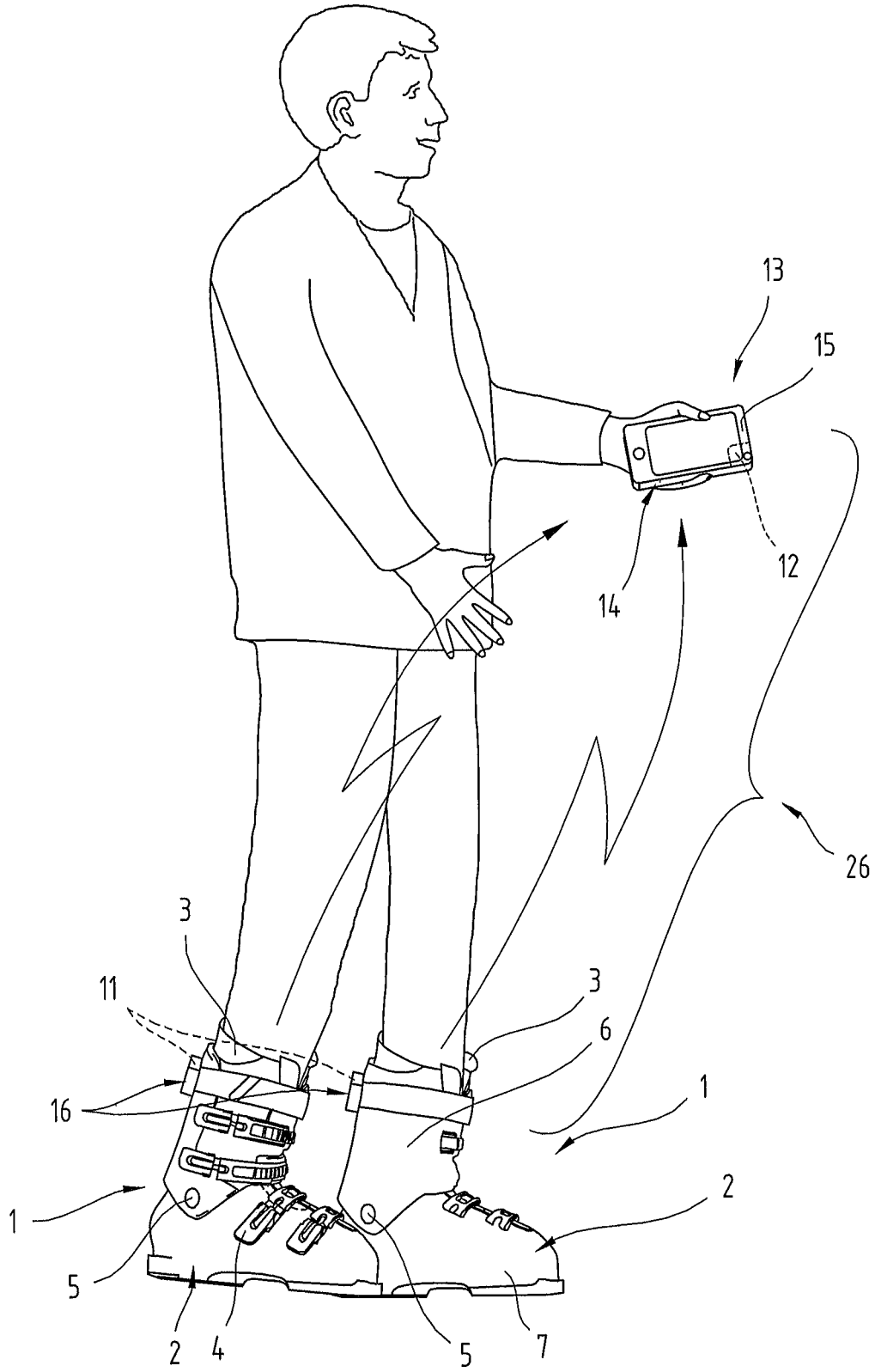

These are highly simplified, schematic diagrams respectively illustrating the following:

FIG. 1 a side view of one embodiment of a sports boot in the form of an alpine ski boot;

FIG. 2 an inner boot for an alpine ski boot which can be removed as an when necessary, having an outer shell made from a relatively hard plastic;

FIG. 3 the sole arrangement of a sports boot, in particular an inner boot for an alpine ski boot, having pressure-sensitive sensors;

FIG. 4 a sports boot, in particular an inner boot of a ski boot, seen from behind;

FIG. 5 a user with a pair of sports boots as proposed by the invention in combination with an electronic control and evaluation system.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

FIG. 1 illustrates a side view of an exemplary sports boot 1, which in this instance is a ski boot.

Instead of the ski boot illustrated as an example here, the corresponding sports boot 1 might also be a cross-country ski boot, a snowboard boot or similar. In particular, every boot which comprises an outer, relatively stiff shell 2 and at least one relatively stiff cuff or shaft portion and a relatively soft and flexible inner boot 3 inserted therein and provided as a means for pursuing ski sport may be regarded as a generic sports boot 1.

The illustrated ski boot essentially comprises an outer, relatively dimensionally stable shell 2 and a relatively form-flexible inner boot 3. The inner boot 3 is preferably made from foam plastic and textile materials in order to afford the user the best wearing comfort possible when the foot of the user is accommodated in the sports boot 1, in particular in the inner boot 3. It is preferable if the inner boot 3 can be removed from the shell 2, as illustrated in FIG. 2, but it may also be that it is permanently joined to the shell 2, in particular bonded or stitched. Based on one possible embodiment, the sports boot 1 may be designed as a touring ski boot, in which case the inner boot 3 may also be laced. Based on one particularly practical embodiment, the sports boot 1 may be designed as an alpine ski boot, in which case the inner boot 3 does not usually have separate closing and/or fastening means.

The outer shell 2, which may be produced by a plastic injection molding process for example, may also have a plurality of orifices and thus form a frame-type or cage-type retaining structure for the inner boot 3. The outer shell 2 around the inner boot 3 is used to transmit forces as efficiently as possible and as far as possible without delay between the user's foot and the respective sports device to which the ski boot is attached or fastened.

In both embodiments of a ski boot, whether it be an alpine ski boot or a touring ski boot, the inner boot 3 is accommodated in the shell 2 and a foot accommodated by the inner boot 3 can be retained in the inner boot 3 by reducing the volume of the shell 2. The volume of the shell 2 is reduced by means of at least one clamping device 4, typically clamping buckles, and a different number of clamping devices 4 may be provided on the shell 2 of a ski boot depending on the design.

The shell 2 preferably comprises a front foot shell 7 for accommodating the foot of a user and a cuff 6 adjoining the front foot shell 7 which at least partially accommodates and surrounds the lower leg portion of a user. The cuff 6—also known as a boot shaft—is preferably designed as a structurally separate element and is connected to the front foot shell 7 via two pivot bearing devices 5. Positioned on opposing side faces of the sports boot 1, the pivot bearing devices 5 therefore form an articulated connection between the cuff 6 and the front foot shell 7 which enables bending between the front foot shell 7 and the cuff 6. This articulated connection may naturally also comprise connecting means which enable a combined translating and rotating coupling.

As illustrated in FIG. 1, two clamping devices 4 may be provided on the front foot shell 7 and on the cuff 6 respectively. However, designs are also possible with two or three clamping devices 4 per sports boot 1 in total. A strap-shaped clamping means 8 may also be provided on the cuff 6 of the sports boot 1, by means of which a foot accommodated in the sports boot 1, in particular the lower leg section of a user, can be additionally stabilized. As may be seen by way of example from FIG. 1, the strap-shaped clamping means 8 for the cuff 6 preferably extends continuously, in particular in a ring shape, around the circumference of the top end portion of the sports boot 1.

A sports boot 1 based on the invention comprises at least one pressure-sensitive sensor 9*a-d* for the electric and/or electronic detection of mechanical pressures or forces in or on the sports boot 1. In particular, at least one sensor 9*a-d* is provided in or on the sports boot 1 which is capable of converting mechanical loads, in particular pressures or forces between the user's foot and the sports boot 1, into corresponding electric signals and providing the corresponding signals. In this context, the at least one electronic sensor 9*a-d* may be configured as an active or passive pressure or force sensor. The at least one sensor 9*a-d* is advantageously configured as a pressure-sensitive resistive element and/or a detector operating on the resistive or ohmic principle. Accordingly, different pressure loads acting on the sensor 9*a-d* are reproduced as different electrical resistance values which can then be differentiated from one another or detected by means of electric signals. Based on one advantageous embodiment, at least one of the pressure-sensitive sensors 9*a-d* of the sports boot 1, in particular on the inner boot 3 thereof, is provided in the form of a textile pressure sensor which enables a high form flexibility or adaptability with respect to the three-dimensional shape of an inner boot 3 and/or with respect to the contours of a foot shape. Such pressure-sensitive sensors 9*a-d* are also known as textile sensors and are well suited for fitting on or integrating in soft elastic or textile objects, in particular with respect to the inner boot 3 of the generic sports boot 1. However, it is also possible for at least one of the sensors 9*a-d* to be provided in the form of a pressure sensor operating in accordance with the piezoelectric principle.

FIG. 2 illustrates pressure-sensitive sensors 9*a-d* in expedient positions on an inner boot 3.

Based on one practical embodiment, at least one sensor 9*a* may be positioned in the front sole portion of the inner boot 3, which front sole portion is disposed next to the ball of the foot or front foot portion of a user in the usage or deployment state of the sports boot 1.

Furthermore, at least one pressure sensitive sensor 9*b* may be positioned in the rear sole portion of the inner boot 3 which is or may lie closest to the heel bone of a user.

Based on a combined evaluation of the pressure signals from or provided by the sensors 9*a* and 9*b*, information can be gleaned about the weight distribution or so-called balance of the user in particular using sensor technology. Using sensors to detect the user's weight distribution with respect to the forefoot and/or heel bone is very important and of practical advantage in particular in connection with ski boots used for alpine skiing because the respective weight distribution and/or the dynamic weight shift of the user can be detected.

Based on another alternative or combined embodiment, at least one pressure-sensitive sensor 9*c* may be provided in or on the inner boot 3 which picks up pressure forces or loads acting on the lower leg or shin part of a user. As schematically illustrated in FIG. 1, this sensor 9*c* is expediently positioned in a section of the sports boot 1 lying closest to the front section of the cuff 6. By way of example, the at least one sensor 9*c* is disposed directly in or on the tongue 10 of the inner boot 3, as indicated by broken lines in FIG. 2. This primarily enables the so-called forward stance and/or shifts in the center of gravity of a user in the forward direction to be practically detected.

Based on one practical feature, at least one pressure-sensitive sensor 9*d* may be provided in the rear portion of the shaft of the inner boot 3, as indicated by dotted-dashed lines FIGS. 1, 2. The rear portion of the inner boot shaft is or may be disposed substantially closest to the calf bone of a user. This primarily enables so-called backward lean and/or shifts in the center of gravity of a user in the rearward direction to be expediently detected.

The embodiment illustrated in FIG. 2 represents positions of the sensors 9*a-d* in the interior structure of the inner boot 3. In particular in this instance, the sensors 9*a-d* are at least partially embedded in the material, in particular in the plastic material of the inner boot 3. Alternatively it would naturally also be possible for at least one of the sensors 9*a-d* to be provided on the outer surface of the inner boot 3 or on the internal face of the inner boot 3 lying closest to the user's foot so as to sit in relatively direct contact with the foot or sock of a user of the sports boot 1.

The respective pressure forces between the user's foot and the sports boot 1 and between the sports boot 1 and the ground underneath, for example a sports device attached to the sports boot 1, can therefore be detected electronically or by sensor technology via the at least one sensor 9*a-d* and evaluated and/or monitored by means of an electronic evaluation means that will be described below.

To enable data processing or evaluation to be operated on an optimized basis, it is of practical advantage if the sports boot 1 has at least one radio communications interface 11. This radio communications interface 11 is provided as a means of wirelessly transmitting pressure signals and/or pressure-related data detected via the at least one pressure-sensitive sensor 9*a-d*. The radio communications interface 11 is therefore configured for a signal and/or data transmission at close range, i.e. for a maximum transmission distance of up to 100 m, preferably up to 3 m. In this respect, it is of advantage if the radio communications interface 11 of the sports boot 1 is configured for signal or data transmission using the Bluetooth, ZigBee, NFC or WLAN standard. RFID communications systems would also be conceivable in this connection. The key aspect is that this radio communications interface 11 of the sports boot 1 is compatible with a standardized, radio communications interface 12 on at least one standardized electronic evaluation device 13. In particular, the communications interface 11 on the sports boot 1 is configured to run a data communication with a cooperating communications interface 12 on an external, preferably mobile, electronic evaluation device 13. In this context, the signal and/or data transmission may be one-way from the communications interface 11 in the direction towards the communications interface 12 of the evaluation device 13. However, it is preferable to provide a two-way data communication between the boot-end communications interface 11 and the external, evaluation-end communications interface 12, as indicated in FIG. 1 by a double arrow. The electronic evaluation device 13 is used at least for evaluating the pressure conditions and/or the electric pressure signals derived therefrom detected by the at least one pressure-sensitive sensor 9*a-d*. In particular, the electric pressure signals of the at least one sensor 9*a-d* are transmitted via the boot-end communications interface 11 in data format to the electronic evaluation device 13 and are processed and evaluated by the latter and signaled in a format that is practical for a user of the evaluation device 13, in particular at least displayed.

The electronic, preferably mobile, evaluation device 13 is preferably provided in the form of a commercially available mobile computer unit 14, in particular defined by a smartphone 15, as illustrated in FIG. 5. As an alternative to or in combination with a smartphone 15, it is also possible to use a standard tablet PC or a so-called wearable computer, for example in the form of a wristwatch. In this context, the standard available radio communications interface 12 of these aforementioned electronic units are compatible with the radio communications interface 11 provided on the sports boot 1. In particular, the radio communications interface 11 on the sports boot 1 is configured so that it can set up a data communication connection with at least one radio communications interface 12 of said mobile computer units 14, in particular with a radio communications interface 12 of a smartphone 15. The mobile computer unit 14, in particular the user's smartphone 15—FIG. 5—establishes a data connection to the communications interfaces 11 provided respectively on each of the two sports boots 1 of the user. In other words, a data connection can be set up or established between the mobile computer unit 14, in particular the smartphone 15, of the user and the two sports boots 1 worn by him/her. A two-channel radio connection can therefore be provided between the pair of sports boots 1 of the user and their smartphone 15.

It may be of practical advantage if the radio communications interface 11 on the respective sports boot 1 is defined by a Bluetooth communications interface, which is compatible with the corresponding, standardly implemented Bluetooth-communications interface 12 of a commercially available, mobile computer unit 14, in particular on a smartphone 15, a tablet PC or on a wearable computer, for example in the form of a wristwatch.

As may best be seen from FIGS. 1 to 4, the at least one pressure-sensitive sensor 9*a-d* of the sports boot 1 is connected or can be connected to an electronic signal processing device 16, in particular by wiring. This electronic signal processing device 16 is preferably disposed or can be positioned on the sports boot 1 and is used amongst other things to condition and/or process the electric pressure signals provided by the at least one pressure-sensitive sensor 9*a-d*. In this context, the sensors 9*a-d* are connected respectively via electrical cable connections 17*a-d* to a microcontroller 18 or a similar electronic evaluation circuit within the signal processing device 16.

It would also be conceivable to assign at least one temperature and/or humidity sensor 19 (FIG. 1) to the signal processing device 16, which transmits electrical signals corresponding to the respectively prevailing temperature and/or humidity conditions via at least one wire to the microcontroller 18 for processing and/or evaluation. As schematically illustrated in FIG. 1, such a temperature and/or humidity sensor 19 may preferably be positioned in the toe or middle foot portion of the sports boot 1. The signal processing device 16 is then provided as a means of wirelessly transmitting the respective temperature and/or humidity data to the mobile computer unit 14, in particular to the smartphone 15, by means of which the respectively prevailing temperature and/or humidity values in the sports boot 1 can be displayed, monitored and/or logged.

The pressure-sensitive sensors 9*a-d* may be configured as pressure/voltage transducers, whilst an optional temperature and/or humidity sensor 19 might also be understood as being a corresponding converter or transducer circuit.

The electronic signal processing device 16 on the sports boot 1 of a user is also coupled with the radio communications interface 11 described above by means of signal transmission and/or the electronic signal processing device 16 comprises this radio communications interface 11. Based on one typical embodiment, such as illustrated in FIG. 1, the microcontroller 18 is connected via at least one data and/or signal line 20 to the typically modular radio communications interface 11. To supply the electronic signal processing device 16 with electrical power, in particular to supply the various sensors and the microcontroller 18 with power, at least one electrical power supply source 21, in particular at least one battery or an electrochemical accumulator, is also provided on or in the signal processing device 16.

The signal processing device 16 further comprises at least one memory device for system-relevant data and operating states. As an alternative or in combination, such data may be stored by the user, in particular by means of his/her mobile computer unit 14, such as his/her smartphone 15 for example, and/or in a memory device (cloud storage) accessible via a data network.

The electronic and/or electric components of the signal processing device 16 are preferably accommodated in a housing 22. By contrast, the pressure-sensitive sensors 9*a-d* in particular are positioned externally relative to the housing 22 and are wired or can be connected to the electronic signal processing device 16 via said electric lines or cable connections 17*a-d* described above—see FIG. 2—either directly but preferably via a plug interface 23 which can be activated and deactivated as and when required. Based on one practical embodiment, the housing 22 of the electronic signal processing device 16 is disposed and/or can be positioned in the cuff region of the sports boot 1, in particular on the rear face of the cuff 6, as illustrated by way of example in FIG. 1. To this end, a retaining device 24, for example a mounting bracket 25 may be provided, by means of which the housing 22 can be fitted in the region close to the upper collar portion of the cuff 6 so as to be detachable if necessary. The electronic signal processing device 16, in particular the housing 22 thereof, is preferably mounted or retained on or in the sports boot 1 so as to be detachable as necessary. Amongst other things, this offers a practical way of charging and/or regenerating the power supply source 21 and a simple way of carrying out maintenance of the electronic signal processing device 16. The boot-end electronic signal processing device 16 and/or communications interface 11 and the peripherally disposed electronic evaluation device 13 and corresponding mobile computer unit 14 for this purpose therefore form an electronic evaluation and/or control system 26—FIG. 5—for the user of the sports boot 1. The corresponding control system 26 also constitutes a helpful tool for sales and service companies of such sports boots 1, in particular sellers of sports equipment, for increasing customer satisfaction.

Based on one practical embodiment, therefore, a sports boot 1, in particular a ski boot, is provided, which sports boot 1 comprises a bottom boot portion 27 for accommodating the foot of a user and an upper boot portion 28 for accommodating the lower leg portion of this user. The upper boot portion 28 is connected to the lower boot portion 27, for example by an articulated coupling, as illustrated in FIG. 1. A generic sports boot 1 is therefore based on a boot design and extends significantly beyond the ankle of a user.

The sports boot 1 comprises a sensor arrangement 29 comprising several distributed pressure-sensitive sensors 9*a-d*. The sensors 9*a-d* are respectively connected or can be connected via at least single-pole, partially via double-pole, cable connections 17*a-d* to the electronic signal processing device 16 which is disposed or can be disposed directly on the sports boot 1.

At least two sensors 9*a*, 9*b* of the sensor arrangement 29 are provided in or on a sole arrangement 30 of the sports boot 1 which can be positioned next to the foot sole of a user. At least one first sensor 9*a* is positioned in a forefoot portion 31 of the sole arrangement 30 of the sports boot 1 and at least one second sensor 9*b* is positioned in a heel portion 32 of the sole arrangement 30. By reference to a sole longitudinal axis, the forefoot portion 31 may occupy approximately one third of the sole length whilst the heel portion 32 may likewise occupy approximately one third of the sole length.

It may be expedient to provide a single first sensor 9*a* which is disposed at least predominantly or entirely eccentrically with respect to the sole longitudinal axis 33, in particular positioned closer in the direction towards the inner face of the sports boot 1, as may be seen from FIGS. 2, 3. This enables relatively clear force measurements to be taken and/or pressure to be detected and meaningful information can therefore be gleaned in a relatively efficient manner about the edging or steering behavior of the user relative to skis used in pairs.

It may also be of practical advantage to provide only a single second sensor 9*b* in the heel portion 32 of the sole arrangement 30 which is positioned as centrally as possible relative to the sole longitudinal axis 33, as schematically illustrated in FIGS. 2, 3. This enables relatively good detection and evaluation results to be obtained in spite of keeping component and hardware costs as low as possible.

By means of single- or multi-pole cable connections 17*a-d*, the individual sensors 9*a-d* are connected or can be connected to the signal processing device 16 in an electrically conducting arrangement. This electrical connection is either provided on a permanent basis or can be established and terminated as and when required. A first cable connection 17*a* between the at least one first sensor 9*a* and the electronic signal processing device 16 and a second cable connection 17*b* between the at least one second sensor 9*b* and the electronic signal processing device 16 runs from the at least one first sensor 9*a* and from the at least one second sensor 9*b* respectively in the direction towards a sole center region 34 which can be disposed next to the foot arch portion or foot central portion of a user, as may best be seen from FIGS. 2, 3. After that, the first and the second cable connection 17*a*, 17*b* run from the sole center region 34 via the heel portion 35—FIG. 2—in the direction towards the upper boot portion 28, in particular towards the boot shaft, in which the signal processing device 16—FIG. 1—is positioned or can be positioned. The cable connections 17*a* respectively 17*b* from the first sensor 9*a* respectively from the second sensor 9*b* run in the direction towards the electronic signal processing device 16, in other words from sensors 9*a*, 9*b* first of all in the direction towards the sole center region 34 of the sole arrangement 30. Only after that are the cable connections 17*a*, 17*b* and/or signal lines from the sensors 9*a*, 9*b* run onwards in the direction towards the upper boot portion 28, to which end the cable connections 17*a*, 17*b* extend via the heel portion 35 of the sports boot 1 and/or the inner boot 3.

Based on one practical feature, the electric ground connections 36, 37 of the at least one first sensor 17*a* and the at least one second sensor 17*b* are grouped and connected to a common electric ground junction 38 in the sole center region 34 and are connected or can be connected via a common ground wire 39—FIG. 3—to the signal processing device 16.

As may best be seen from FIG. 2, at least one third pressure sensitive sensor 9*c* may be disposed in a tongue portion 40 of the tongue 10 of the sports boot 1 which is placed closest to the shin of a user. This sensor 9*c* is connected or can be connected via a third cable connection 17*c* to the signal processing device 16. The third cable connection 17*c* runs between the third sensor 9*c* and the signal processing device 16, starting from the third sensor 9*c* via the tongue portion 40, the instep portion 41, the toe portion 42, the sole arrangement 30 and via the heel portion 35 of the sports boot 1 in the direction towards the rear end of the upper boot portion 28 in which the signal processing device 16 is preferably disposed or can be disposed. In this connection, it is of advantage if a ground wire 43 of the third cable connection 17*c* to and/or from the third sensor 9*c* terminates in the sole center region 34 and is connected to the common electric ground junction 38, as illustrated in FIG. 3. The cable connections 17*a-d* to and/or at the sensors 9*a-d* respectively comprise—in a manner known per se—a signal line and an associated ground wire.

In this respect, it is of advantage if the ground junction 38, which is typically disposed in or on the sole arrangement 30, is positioned in the sole center region 34.

It may likewise be of advantage if the cable connections 17*a-d* and/or at least individual ones of these cable connections 17*a-d* run in groove-type recesses 46, for example in indentations or compacted material embossing of the sole arrangement 30. In particular, several recesses 46 may be provided in the bottom face of a sole layer 45 of the sole arrangement 30, as schematically illustrated in FIGS. 3, 4. In this respect, as may also best be seen from FIG. 4, the bottom face of the sole layer 45 may be glued with a protective layer 47 at least in individual portions overlapping the groove-type recesses 46 and/or the free space 44 for the ground junction 38. This protective layer 47 may be provided as a plastic layer and/or textile layer, which protective layer 47 has a thickness of less than 2 mm, preferably between 0.5 mm and 1.8 mm.

Based on one practical embodiment, the at least one first sensor 17*a* and the at least one second sensor 17*b* are configured as thin film resistance sensors having a limited, in particular circular, surface area which are glued to or stitched onto the bottom face of the sole layer 45 of the sole arrangement 30, as may best be seen from FIG. 3. Optionally, the entire bottom face of the sole arrangement 30—illustrated in FIG. 3—may be faced or lined with the protective layer 47—illustrated in FIG. 4.

It is also of practical advantage if at least one fourth pressure sensitive sensor 17*d* is disposed in a calf portion 48 of the sports boot 1 which can be placed closest to the calf of a user, which is connected or can be connected via a fourth cable connection 17*d* to the signal processing device 16, as illustrated in FIG. 2.

Based on one practical embodiment, the cable connections 17*a-d* in the upper boot portion 28 are run into a first plug interface 23. This first plug interface 23, which may be configured as a plug socket 49 in particular, can be electrically coupled with a cooperating second plug interface 50, in particular a plug element 51. The second plug interface 50 may be provided directly on the signal processing device 16, in particular on the housing 22 thereof, or may be run to the signal processing device 16 via a fifth cable connection 52. It is also of advantage if the fourth cable connection 17*d* is run from the fourth sensor 9*d* positioned in the calf portion 48 directly to the first plug interface 23, as may best be seen from FIG. 2.

By contrast, it is of practical advantage if the first, second and third cable connections 17*a-c* are run from the heel portion 35, via the Achilles portion of the sports boot 1 in the vertical direction up to the first plug interface 23, as may best be seen from FIGS. 2 and 3.

As may best be seen from FIG. 2, at least one of the cable connections 17*a-c* from the pressure-sensitive sensors 9*a-c* to the plug interface 23 and/or to the signal processing device 16 forms at least one arcuate deflection 53 at least in the run inside the sole arrangement 30 of the inner boot 3 which is provided as a means of compensating for length during the course of flexing and/or walking movements with the inner boot 3. This is conducive to the robustness, long service life and functional reliability of the sports boot 1 and the inner boot 3 thereof.

Based on one preferred embodiment, the first plug interface 23 is positioned in the top end or collar portion of the upper boot portion 28, in particular in the region of the cuff of the sports boot 1, as schematically illustrated in FIGS. 1 and 4.

The cable connections 17*a-d* may be provided in the form of electric cables and/or individual wires. Alternatively or in combination, it is also possible for at least part-sections of at least one of the cable connections 17*a-d* to be provided in the form of multipolar film-type conductor tracks, in particular conductor tracks printed on plastic films, as schematically illustrated in FIGS. 3 and 4. This offers the advantage of being able to use relatively thin cable connections 17*a-d* in the relatively soft structure of the inner boot 3 that are therefore particularly free of pressure points.

The embodiments illustrated as examples represent possible variants and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

The protective scope is defined by the claims. However, the description and drawings may be used as a reference for interpreting the claims. Individual features or combinations of features from the different embodiments illustrated and described may be construed as independent inventive solutions or solutions proposed by the invention in their own right. The objective underlying the independent inventive solutions may be found in the description.

For the sake of good order, finally, it should be pointed out that, in order to provide a clearer understanding of the structure, some elements are illustrated to a certain extent out of scale and/or on an enlarged scale and/or on a reduced scale.

List of reference numbers

| | |
|---|---|
| 1 | Sports boot |
| 2 | Shell |
| 3 | Inner boot |
| 4 | Clamping device |
| 5 | Pivot bearing device |
| 6 | Cuff |
| 7 | Front foot shell |
| 8 | Clamping means |
| 9a, 9b | Sensor |
| 9c, 9d | Sensor |
| 10 | Tongue |
| 11 | Communications interface |
| 12 | Communications interface |
| 13 | Evaluation device |
| 14 | Mobile computer unit |
| 15 | Smartphone |

-continued

| List of reference numbers | |
|---|---|
| 16 | Signal processing device |
| 17a, 17b | Line |
| 17c, 17d | Line |
| 18 | Microcontroller |
| 19 | Temperature and/or humidity sensor |
| 20 | Data and/or signal line |
| 21 | Power supply source |
| 22 | Housing |
| 23 | Plug interface (first) |
| 24 | Retaining device |
| 25 | Mounting bracket |
| 26 | Control system |
| 27 | Boot portion (lower) |
| 28 | Boot portion (upper) |
| 29 | Sensor arrangement |
| 30 | Sole arrangement |
| 31 | Forefoot portion |
| 32 | Heel portion |
| 33 | Sole longitudinal axis |
| 34 | Sole center region |
| 35 | Heel portion |
| 36 | Ground connection |
| 37 | Ground connection |
| 38 | Ground junction |
| 39 | Ground cable |
| 40 | Tongue portion |
| 41 | Instep portion |
| 42 | Toe portion |
| 43 | Ground cable |
| 44 | Free space |
| 45 | Sole layer |
| 46 | Recess |
| 47 | Protective layer |
| 48 | Calf portion |
| 49 | Plug socket |
| 50 | Plug interface (second) |
| 51 | Plug element |
| 52 | Cable connection (fifth) |
| 53 | Deflection |

The invention claimed is:

1. A ski boot for the pursuit of ski sport, comprising:

an outer shell made from plastic;

an inner boot made from materials softer than the plastic, the inner boot being insertable into and removable from the outer shell;

a lower boot portion configured to accommodate a foot of a user;

an upper boot portion configured to accommodate a lower leg portion of the user, which upper boot portion is connected to the lower boot portion;

a sole arrangement in the lower boot portion, the sole arrangement comprising a forefoot portion, a sole center region and a heel portion;

a sensor arrangement comprising first and second pressure-sensitive sensors in a distributed layout, which are respectively connected or are connectable to an electronic signal processing device, the electronic signal processing device being positioned or being able to be positioned in the upper boot portion, at least the first and second pressure-sensitive sensors being provided on the sole arrangement, and at least the first sensor being positioned in the forefoot portion of the sole arrangement and at least the second sensor being positioned in the heel portion of the sole arrangement;

a first cable connection between the first pressure-sensitive sensor and the electronic signal processing device, the first cable connection starting from the first pressure-sensitive sensor and running in a first direction towards the sole center region of the sole arrangement; and a second cable connection between the second pressure-sensitive sensor and the electronic signal processing device, the second cable connection starting from the second pressure-sensitive sensor and running in a second direction towards the sole center region;

wherein the first and second cable connections run out from the sole center region via the heel portion in a third direction towards the upper boot portion;

wherein the ski boot further comprises a first plug interface and a second plug interface able to be electrically coupled to the first plug interface;

wherein in the upper boot portion the first and the second cable connections run into the first plug interface;

wherein the second plug interface is provided on the electronic signal processing device or is run to the electronic signal processing device via a further cable connection and wherein the first plug interface is positioned in a top end portion of the upper boot portion.

2. The ski boot according to claim 1, further comprising:

electric ground connections of the first pressure-sensitive sensor and of the second pressure-sensitive sensor; and a common electric ground junction, the common electric ground junction being in the sole center region;

wherein the electric ground connections are grouped at the common electric ground junction and are connected or are connectable via a common ground wire to the electronic signal processing device.

3. The ski boot according to claim 1, further comprising:

a tongue having a tongue portion;

an instep portion;

a toe portion; and a third cable connection, the third cable connection running via the instep portion, the toe portion, and the sole arrangement;

wherein the sensor arrangement further comprises a third pressure-sensitive sensor disposed in the tongue portion, the third pressure-sensitive sensor being connected or connectable via the third cable connection to the electronic signal processing device.

4. The ski boot according to claim 2, further comprising a third cable connection comprising a ground wire, the ground wire of the third cable connection terminating in the sole center region and being connected to the common electric ground junction.

5. The ski boot according to claim 1, wherein the sole arrangement comprises a sole layer having a bottom face and recesses or indentations in the bottom face; and wherein the first and the second cable connections run in the recesses or the indentations provided in the bottom face.

6. The ski boot according to claim 2, wherein the sole arrangement comprises a sole layer having a bottom face having a free space; and wherein the common electric ground junction is disposed in the free space.

7. The ski boot according to claim 1, wherein the sole arrangement further comprises a sole layer having a bottom face; and wherein the first pressure-sensitive sensor and the second pressure-sensitive sensor are configured as thin film resistance sensors having a limited surface area and are glued to or stitched onto the bottom face of the sole layer of the sole arrangement.

8. The ski boot according to claim 5, wherein the bottom face of the sole layer is glued with a protective layer at least in portions overlapping the recesses or the indentations; and wherein the protective layer has a thickness of less than 2 mm.

9. The ski boot according to claim 1, further comprising a calf portion;

a calf pressure-sensitive sensor disposed in the calf portion; and a further cable connection;

wherein the calf pressure-sensitive sensor is connected or connectable via the further cable connection to the electronic signal processing device.

10. The ski boot according to claim 9, wherein the further cable connection is run directly to the first plug interface.

11. The ski boot according to claim 1, further comprising an Achilles portion;

wherein the first and the second cable connections are run from the heel portion, via the Achilles portion, in the third direction up to the first plug interface.

12. The ski boot according to claim 1, wherein the inner boot has the sole arrangement; and wherein at least one of the first and the second cable connections forms at least one arcuate deflection at least in a run inside the sole arrangement of the inner boot, the at least one arcuate deflection compensating for length during a course of flexing and/or walking movements with the inner boot.

* * * * *